US007843412B2

(12) United States Patent
So

(10) Patent No.: US 7,843,412 B2
(45) Date of Patent: Nov. 30, 2010

(54) APPARATUS AND METHOD FOR DRIVING LIQUID CRYSTAL DISPLAY DEVICE

(75) Inventor: Hyun Jin So, Seoul (KR)

(73) Assignee: LG Display Co., Ltd., Seoul (KR)

( * ) Notice: Subject to any disclaimer, the term of this patent is extended or adjusted under 35 U.S.C. 154(b) by 732 days.

(21) Appl. No.: 11/638,441

(22) Filed: Dec. 14, 2006

(65) Prior Publication Data

US 2007/0200811 A1 Aug. 30, 2007

(30) Foreign Application Priority Data

Feb. 27, 2006 (KR) ..... 10-2006-0018810

(51) Int. Cl.
*G09G 3/36* (2006.01)

(52) U.S. Cl. ..... 345/87; 345/89; 345/100

(58) Field of Classification Search ..... 345/28–39, 345/44–46, 48, 50–52, 55, 77, 82–100, 204–207, 345/211, 214
See application file for complete search history.

(56) References Cited

U.S. PATENT DOCUMENTS

| | | | | |
|---|---|---|---|---|
| 6,825,824 | B2 * | 11/2004 | Lee | 345/89 |
| 7,006,113 | B2 * | 2/2006 | Yamamoto et al. | 345/690 |
| 7,158,107 | B2 * | 1/2007 | Kawabe et al. | 345/89 |
| 2005/0104837 | A1 * | 5/2005 | Baik et al. | 345/99 |
| 2007/0171163 | A1 * | 7/2007 | Miyata | 345/87 |

FOREIGN PATENT DOCUMENTS

| | | |
|---|---|---|
| JP | 02-213282 | 8/1990 |
| JP | 02-309870 | 12/1990 |
| JP | 09-009690 | 1/1991 |
| JP | 09-312855 | 12/1997 |
| JP | 11-046313 | 2/1999 |
| JP | 11-164319 | 6/1999 |
| JP | 2000-332998 | 11/2000 |
| JP | 2002-305753 | 10/2002 |
| JP | 2004-080787 | 3/2004 |
| JP | 2004-357243 | 12/2004 |
| JP | 2005-309570 | 11/2005 |
| JP | 2005-340954 | 12/2005 |
| JP | 2006-018002 | 1/2006 |

* cited by examiner

*Primary Examiner*—Richard Hjerpe
*Assistant Examiner*—Mansour M Said
(74) *Attorney, Agent, or Firm*—Morgan Lewis & Bockius LLP

(57) ABSTRACT

An apparatus and method for driving an LCD device is disclosed, in which resolution of images can be improved by the difference in gray level between adjacent pixels of video data. The apparatus for driving an LCD device includes an LCD panel having a plurality of gate lines and a plurality of data lines, a data converter analyzing the difference in gray level between adjacent pixels of input video data and outputting modulated video data if the difference of gray level between adjacent pixels is larger than a reference value, a timing controller aligning and outputting the modulated video data, a gate driver supplying scan pulses to the gate lines of the LCD panel, and a data driver supplying the modulated video data to the data lines of the LCD panel.

14 Claims, 5 Drawing Sheets

APPARATUS AND METHOD FOR DRIVING LIQUID CRYSTAL DISPLAY DEVICE

This application claims the benefit of the Korean Patent Application No. 10-2006-188810, filed on Feb. 27, 2006, which is hereby incorporated by reference.

BACKGROUND OF THE INVENTION

1. Field of the Invention

The present invention relates to a liquid crystal display (LCD) device, and more particularly, to an apparatus and method for driving an LCD device, in which resolution of images can be improved by increasing the difference in gray level between adjacent pixels of video data.

2. Discussion of the Related Art

Recently, various flat panel displays that can reduce weight and volume of a cathode ray tube have been developed. Examples of the flat panel displays include a liquid crystal display (LCD) device, a field emission display (FED) device, a plasma display panel (PDP) device, and a light emitting display (LED) device. Among them, the LCD device includes a thin film transistor (TFT) array substrate, a color filter array substrate, and a liquid crystal layer between the thin film transistor array substrate and the color filter array substrate. The thin film transistor array substrate has a plurality of pixel electrodes arranged in pixel regions defined by a plurality of data lines and a plurality of gate lines, and a thin film transistor serving as switching elements formed in the respective pixel electrodes.

FIG. 1 is a schematic diagram of an apparatus for driving an LCD device according to the related art. As shown in FIG. 1, the apparatus includes an LCD panel 10 having first to nth gate lines GL1 to GLn and first to mth data lines DL1 to DLm, the gate lines GL1 to GLn crossing the data lines DL1 to DLm to define pixel regions, a data driver 20 supplying analog video signals to the data lines DL1 to DLm, a gate driver 30 supplying scan pulses to the gate lines GL1 to GLn, and a timing controller 40 aligns external input video data RGB, supplies the aligned data to the data driver 20, generates data control signals DCS to control the data driver 20, and generates gate control signals GCS to control the gate driver 30.

Although not shown, the LCD panel 10 includes a thin film transistor array substrate, a color filter array substrate, a spacer, and a liquid crystal. The thin film transistor array substrate and the color filter array substrate face each other and are bonded to each other. The spacer uniformly maintains a cell gap between the two array substrates. The liquid crystal is filled in the cell gap between the two array substrates.

The LCD panel 10 includes TFTs formed in pixel regions where the gate lines GL1 to GLn cross the data lines DL1 to DLm, wherein pixel electrodes are connected to the TFTs. The data signals from the data lines DL1 to DLm are supplied to the TFT by pixel electrodes when the scan pulses from the gate lines GL1 to GLn turn ON the TFTs. Although not shown, the pixel electrode faces a common electrode by interposing the liquid crystal therebetween to form a liquid crystal capacitor Clc and is overlapped with the previous gate lines GL1 to GLn to form a storage capacitor Cst. The liquid crystal capacitor Clc and the storage capacitor Cst maintain the data signals applied to the pixel electrodes until the next data signals are applied thereto.

The timing controller 40 aligns externally input source data RGB to be suitable for driving of the LCD panel 10 and supplies the aligned data to the data driver 20. Also, the timing controller 40 generates the data control signals DCS and the gate control signals GCS using a main clock MCLK, a data enable signal DE, and horizontal and vertical synchronizing signals Hsync and Vsync, which are externally input so as to control each driving timing of the data driver 20 and the gate driver 30.

The gate driver 30 includes a shift register that sequentially generates scan pulses. The shift register generates gate high pulses in response to a gate start pulse (GSP) and a gate shift clock (GSC) among the gate control signals GCS that is generated from the timing controller 40. The gate driver 30 sequentially supplies the gate high pulses to the gate lines GL1 to GLn of the LCD panel 10 to turn ON the TFTs connected to the gate lines GL1 to GLn.

The data driver 20 converts the data signals aligned from the timing controller 40 into the analog video signals in response to the data control signals DCS supplied from the timing controller 40, and supplies the analog video signals to the data lines DL1 to DLm. The data signals correspond to one horizontal line per one horizontal period in which the scan pulses are supplied into the gate lines GL1 to GLn and are supplied to the data lines.

However, the related art apparatus and method for driving an LCD device has several problems. In the related art method for driving an LCD device, the externally input source data RGB are supplied to the respective data lines DL1 to DLm through the data driver 20 without a separate process. Accordingly, the resolution is deteriorated when text messages in stationary images or moving images, which require fineness, are displayed.

SUMMARY OF THE INVENTION

Accordingly, the present invention is directed to an apparatus and method for driving an LCD device that substantially obviates one or more problems due to limitations and disadvantages of the related art.

An object of the present invention is to provide an apparatus and method for driving an LCD device, in which resolution of images can be improved by the difference in gray level between adjacent pixels of input video data.

Accordingly, the present invention is directed to, which substantially obviates one or more problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the apparatus for driving liquid crystal display devices includes an LCD panel having a plurality of gate lines and a plurality of data lines, a data converter analyzing the difference in gray level between adjacent pixels of input video data and outputting modulated video data if the difference of gray level between adjacent pixels is larger than a reference value, a timing controller aligning and outputting the modulated video data, a gate driver supplying scan pulses to the gate lines of the LCD panel, and a data driver supplying the modulated video data to the data lines of the LCD panel.

In another aspect, the method for driving liquid crystal display devices includes separating luminance data and chrominance data from externally input video data, delaying the chrominance data, generating modulated luminance data having increased difference in gray level between first and second luminance data if the difference in gray level between the first and second luminance data is larger than a reference value, and generating modulated video data by mixing the chrominance data and the modulated luminance data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
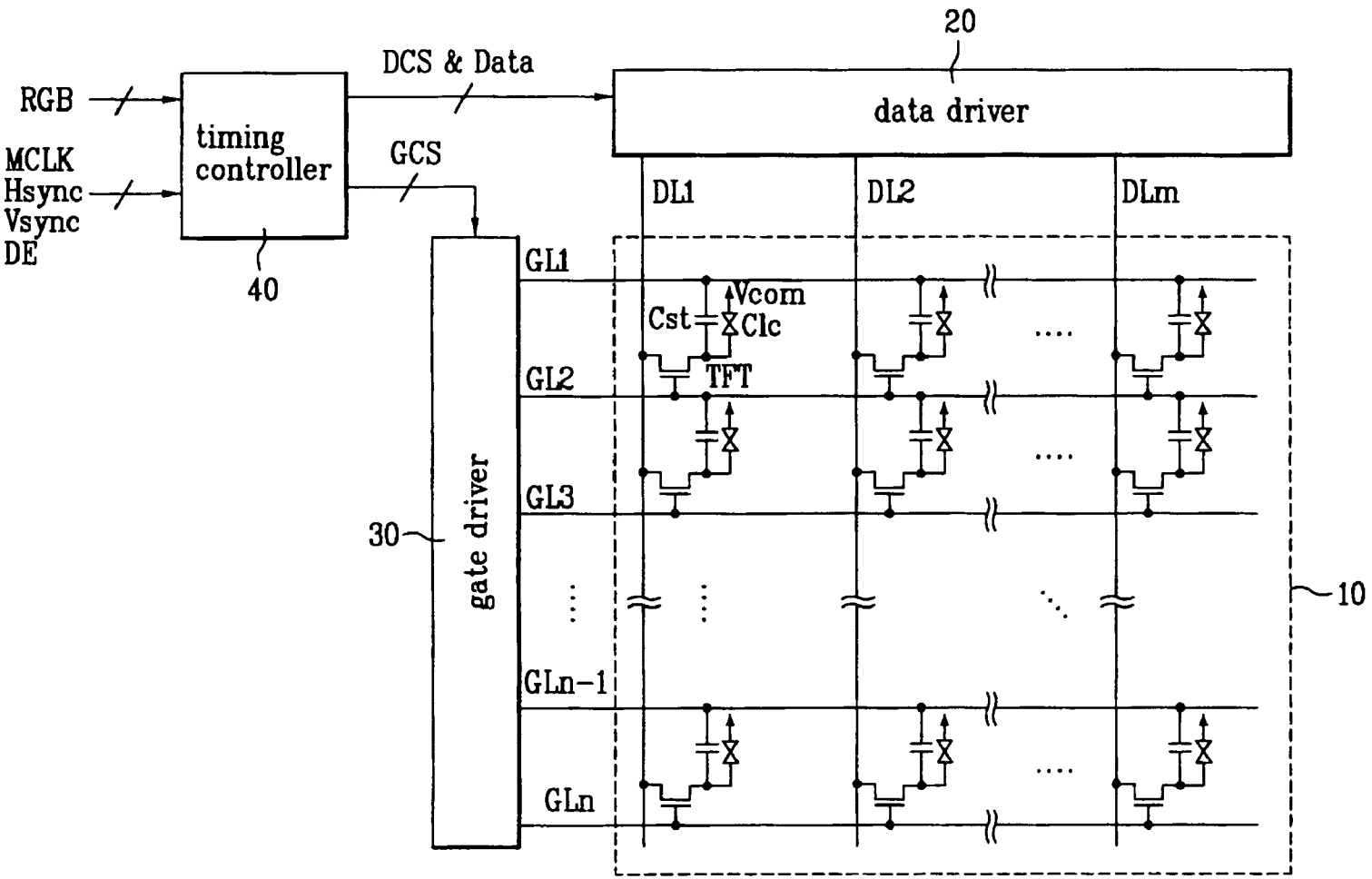
FIG. 1 is a schematic view of an apparatus for driving an LCD device according to the related art.
Figure 2:
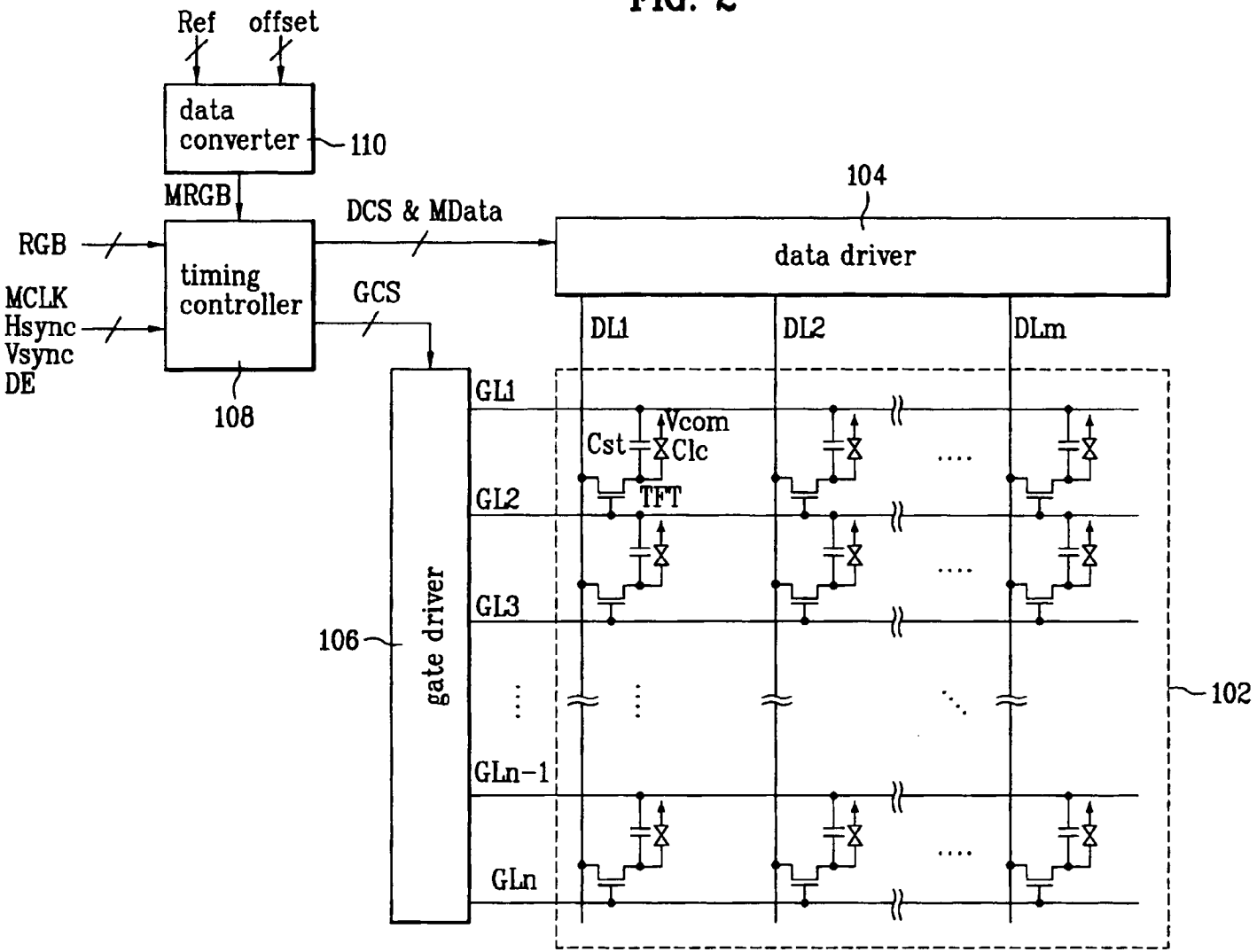
FIG. 2 is a schematic view of an exemplary apparatus for driving an LCD device according to the present invention.

FIG. 2 is a schematic view of an exemplary apparatus for driving an LCD device according to the present invention. As shown in FIG. 2, the apparatus includes an LCD panel 102 having first to nth gate lines GL1 to GLn and first to mth data lines DL1 to DLm, the gate lines GL1 to GLn vertically crossing the data lines DL1 to DLm to define pixel regions, a data driver 104 supplying video data signals to the data lines DL1 to DLm, a gate driver 106 supplying scan pulses to the gate lines GL1 to GLn, a data converter 110 converting externally input video data RGB into modulated data MRGB, and a timing controller 108 aligning the modulated data MRGB from the data converter 110, supplying the aligned data to the data driver 104, generating data control signals DCS to control the data driver 104, and generating gate control signals GCS to control the gate driver 106.

The LCD panel 102 includes TFTs formed in pixel regions defined by the gate lines GL1 to GLn and the data lines DL1 to DLm, wherein pixel electrodes are connected to the TFTs to drive liquid crystal molecules. The TFTs supply data signals from the data lines DL1 to DLm to the pixel electrodes in response to the scan pulses from the gate lines GL1 to GLn. Although not shown, the pixel electrode faces a common electrode by interposing the liquid crystal therebetween to form a liquid crystal capacitor Clc and overlaps with the previous gate lines GL1 to GLn to form a storage capacitor Cst. The liquid crystal capacitor Clc and the storage capacitor Cst maintain the data signals applied to the pixel electrodes until the next data signals are applied thereto.

The data converter 110 extracts luminance data from the externally input video data RGB and converts the gray level of the extracted luminance data using externally input reference value Ref and offset to generate the modulated data MRGB and supplies the modulated data to the timing controller 108. The timing controller 108 aligns the modulated data RRGB supplied from the data converter 110 to be suitable for driving of the LCD panel 102 and supplies the aligned data to the data driver 104. Also, the timing controller 108 generates the data control signals DCS and the gate control signals GCS using a main clock MCLK, a data enable signal DE, and horizontal and vertical synchronizing signals Hsync and Vsync, which are externally input so as to control each driving frequency of the data driver 104 and the gate driver 106.

The gate driver 106 includes a shift register that sequentially generates scan pulses (gate high pulses) in response to a gate start pulse GSP and a gate shift clock GSC among the gate control signals GCS from the timing controller 108. The TFTs are turned on according to the scan pulses. The data driver 104 converts the modulated data MData aligned from the timing controller 108 into the analog video data signals in response to the data control signals DCS supplied from the timing controller 108. The data drive 104 further supplies the analog video data signals to the data lines DL1 to DLm corresponding to one horizontal gate line (one of GL1~GLn) per one horizontal period in which one scan pulse is supplied into one gate line. In other words, the data driver 104 selects a gamma voltage having a predetermined level in accordance with a gray level value of the aligned modulated data MData and supplies the selected gamma voltage to the data lines DL1 to DLm.

Figure 3:
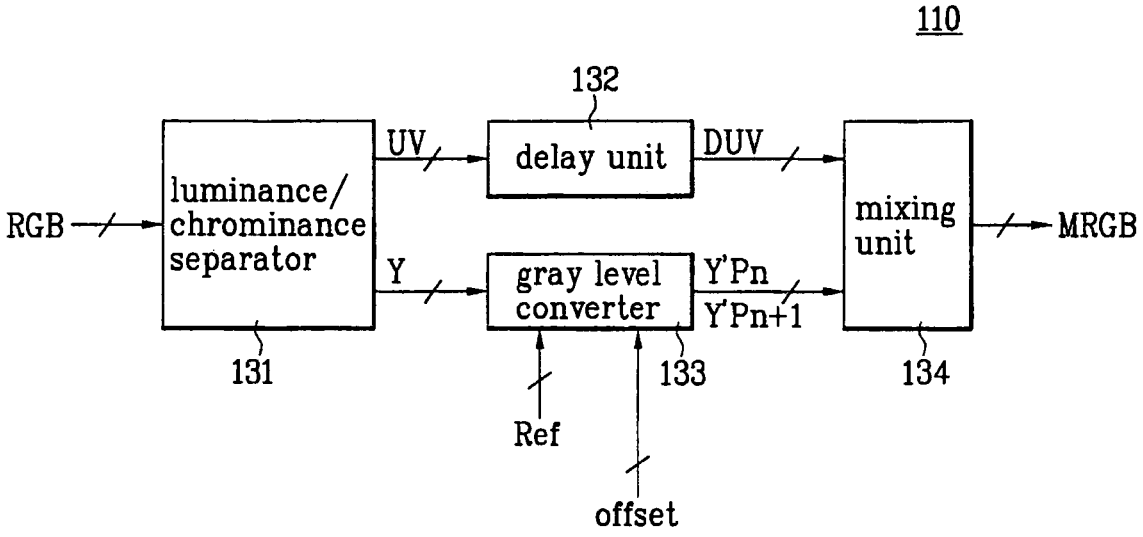
FIG. 3 is a schematic view of the exemplary data converter shown in FIG. 2 according to the present invention.

FIG. 3 is a schematic view of the exemplary data converter shown in FIG. 2 according to the present invention. As shown in FIG. 3, the data converter 110 includes a luminance/chrominance separator 131 separating luminance data Y and chrominance data UV from the externally input video data RGB, a delay unit 132 delaying the chrominance data UV separated from the luminance/chrominance separator 131, a gray level converter 133 increasing the difference in gray level between two luminance data YPn and YPn+1 from the luminance/chrominance separator 131 using the externally input reference values Ref and offset, and a mixing unit 134 generating the modulated data MRGB using the delayed chrominance data DUV and the converted luminance data Y'Pn and Y'Pn+1. The data converter 110 can analyze the difference in gray level using at least one pixel data from one horizontal line information of the externally input video data RGB.

The luminance/chrominance separator 131 separates the luminance data Y and the chrominance data UV from the externally input video data RGB. The luminance data Y and the chrominance data UV are obtained by the following equations, i.e., Equations 1 to 3.

$$Y=0.229\times R+0.587\times G+0.114\times B \quad \text{[Equation 1]}$$

$$U=0.493\times(B-Y) \quad \text{[Equation 2]}$$

$$V=0.887\times(R-Y) \quad \text{[Equation 3]}$$

The luminance/chrominance separator 131 supplies the luminance data Y separated from the externally input video data RGB by the equations 1 to 3 to the gray level converter 133 and also supplies the chrominance data UV to the delay unit 132. The gray level converter 133 compares the difference in gray level between first luminance data YPn of two pixels among the data corresponding to the previous horizontal line and second luminance data YPn+1 of two pixels among the data corresponding to the current horizontal line with the externally input reference value Ref.

The first luminance data YPn and the second luminance data YPn+1 may be either the luminance data corresponding to one horizontal line or the luminance data of 1, 2, and 4 pixels among the data corresponding to one horizontal line. The gray level converter 133 analyzes the difference in gray level between adjacent pixels by comparing the difference in gray level between the first luminance data YPn and the second luminance data YPn+1 with the reference value Ref. In addition, the gray level converter 133 determines whether to add or subtract the offset to or from the first luminance data YPn and the second luminance data YPn+1 in accordance with the analyzing result. Specifically, the gray level converter 133 determines that the difference in gray level between adjacent pixels is small if the difference in gray level between the first luminance data YPn and the second luminance data YPn+1 is smaller than the reference value Ref. Likewise, the gray level converter 133 determines that the difference in gray level between adjacent pixels is large if the difference in gray level between the first luminance data YPn and the second luminance data YPn+1 is larger than the reference value Ref. Also, if it is determined that the difference in gray level is large, the gray level converter 133 increases the difference in gray level between the first luminance data YPn and the second luminance data YPn+1 by adding or subtracting the offset to or from the first luminance data YPn and the second luminance data YPn+1. The detailed constitution and operation of the gray level converter will be described later.

The delay unit 132 generates delayed chrominance data DUV by delaying the chrominance data UV while the gray level converter 133 converts the luminance data Y. The delay unit 132 supplies the delayed chrominance data DUV to the mixing unit 134 to synchronize with the modulated first and second luminance data Y'Pn and Y'Pn+1.

The mixing unit 134 generates the modulated data MRGB using the modulated first and second luminance data Y'Pn and Y'Pn+1 and the delayed chrominance data DUV. The modulated data MRGB are obtained by the following equations, i.e., Equations 4 to 6.

$$MR=Y'+0.000\times DU+1.140\times DV \quad \text{[Equation 4]}$$

$$MG=Y'-0.396\times DU-0.581\times DV \quad \text{[Equation 5]}$$

$$MB=Y'+2.029\times DU+0.000\times DV \quad \text{[Equation 6]}$$

Figure 4:
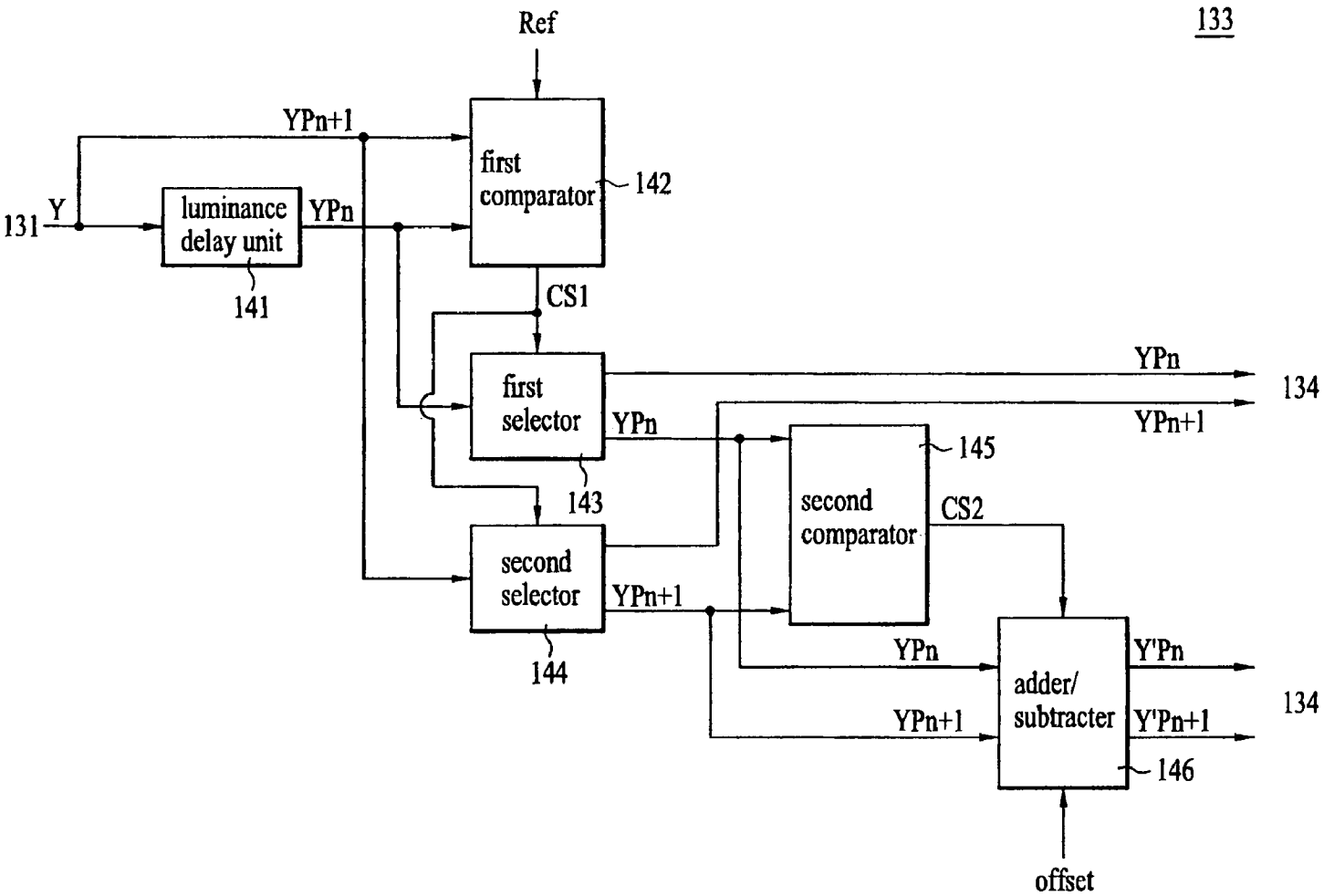
FIG. 4 is a schematic view of the exemplary gray level converter shown in FIG. 3 according to the present invention.

FIG. 4 is a schematic view of the exemplary gray level converter shown in FIG. 3 according to the present invention. As shown in FIG. 4, the gray level converter 133 includes a luminance delay unit 141 delaying the luminance data Y separated from the luminance/chrominance separator 131 to output the first luminance data YPn and a first comparator 142 comparing the difference in gray level between the first luminance data YPn and the second luminance data YPn+1 with the reference value Ref to output a first selection signal CS1 in accordance with the comparison result. The gray level converter 133 further includes a first selector 143 determining an output position of the second luminance data YPn+1 in accordance with the first selection signal CS1, and a second selector 144 determining an output position of the first luminance data YPn in accordance with the first selection signal CS1. The gray level converter 133 further includes a second comparator 145 comparing gray levels of the first and second luminance data YPn and YPn+1 supplied from the first and second selectors 143 and 144 with each other to output a second selection signal CS2 in accordance with the comparison result, and an adder/subtracter 146 adding and subtracting the offset to and from the first and second luminance data YPn and YPn+1 in accordance with the second selection signal CS2. The converted first and second luminance data Y'Pn and Y'Pn+1 are transmitted to the mixing unit 134.

Figure 5:
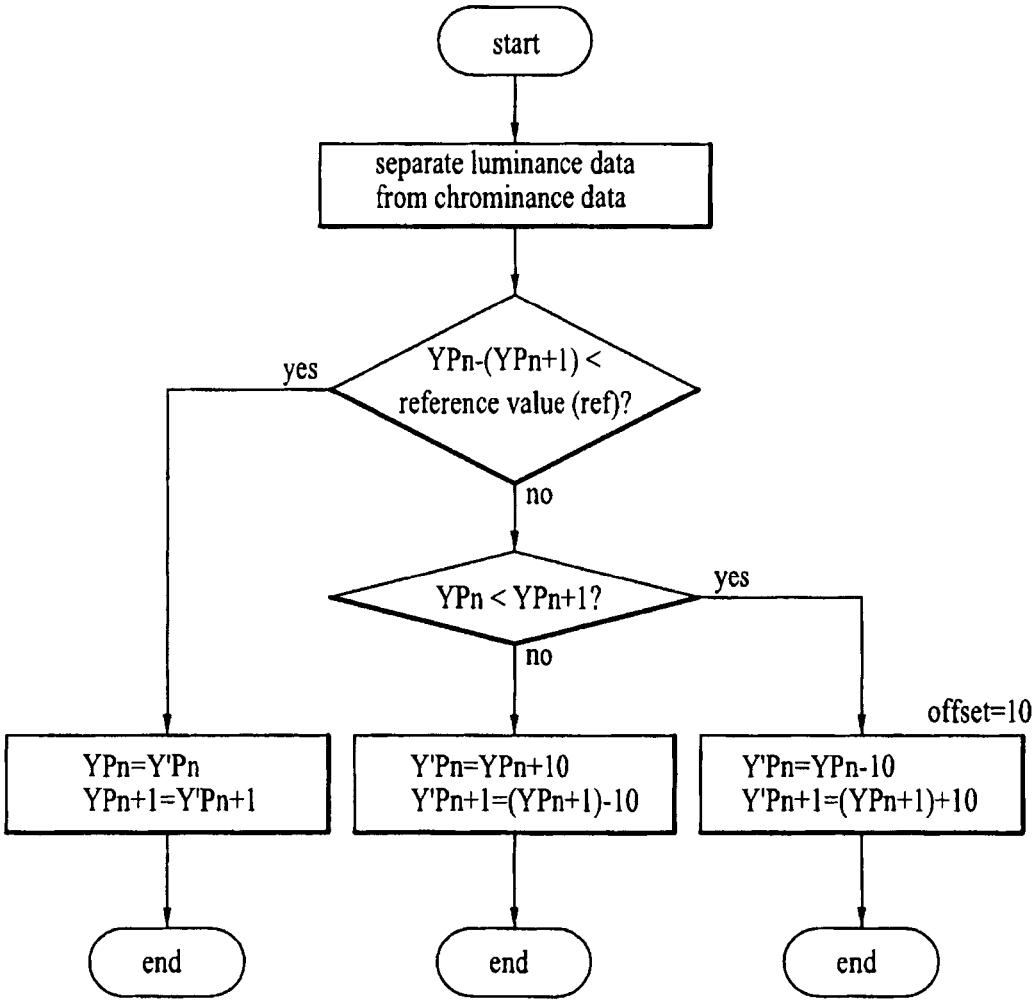
FIG. 5 is a flow chart illustrating an exemplary method for driving the gray level converter shown in FIG. 4 according to the present invention.

FIG. 5 is a flow chart illustrating an exemplary method for driving the gray level converter shown in FIG. 4 according to the present invention. The method for driving the gray level converter 133 shown in FIG. 4 will be described with reference to FIG. 5. The first luminance data YPn is that the luminance data Y from the luminance/chrominance separator 131 is delayed by the luminance delay unit 141. The first luminance data YPn synchronizes with the second luminance data Ypn+1. Thereafter, the first and second luminance data YPn and YPn+1 are transmitted to the first comparator 142. The first comparator 142 compares the reference value Ref with the difference in gray level between the first luminance data YPn and the second luminance data YPn+1. The first comparator 142 has the condition according to Equation 7.

$$|YPn-(YPn+1)|<\text{reference value (Ref)} \quad \text{[Equation 7]}$$

If the condition in Equation 7 is satisfied, i.e., if it is determined that the difference in gray level between the first luminance data YPn and the second luminance data YPn+1 is smaller than the reference value Ref, then the first comparator 142 transmits the first selection signal CS1 of a first logic state to the first selector 143 and the second selector 144. The first selector 143 transmits the first luminance data YPn to the mixing unit 134 in accordance with the first selection signal CS1 of the first logic state. Also, the second selector 144 transmits the second luminance data YPn+1 to the mixing unit 134.

However, if the condition expressed by the Equation 7 is not satisfied, i.e., if it is determined that the difference in gray level between the first luminance data YPn and the second luminance data YPn+1 is larger than the reference value Ref, then the first comparator 142 transmits the first selection signal CS1 of a second logic state to the first selector 143 and the second selector 144. In this case, the first selector 143 transmits the first luminance data YPn to the second comparator 145 in accordance with the first selection signal CS1 of the second logic state. Also, the second selector 144 transmits the second luminance data YPn+1 to the second comparator 145 in accordance with the first selection signal CS1 of the second logic state.

The second comparator 145 compares gray level of the first luminance data YPn with gray level of the second luminance data YPn+1.

$$YPn>YPn+1 \quad \text{[Equation 8]}$$

If the condition expressed by the Equation 8 is satisfied in the second comparator 145, i.e., if it is determined that the gray level of the first luminance data YPn is larger than the gray level of the second luminance data YPn+1, the second comparator 145 transmits the second selection signal CS2 of the first logic state to the adder/subtracter 146. The adder/subtracter 146 adds the offset to the gray level of the first luminance data YPn in accordance with the second selection signal CS2 of the first logic state. Also, the adder/subtracter 146 subtracts the offset from the gray level of the second luminance data YPn+1 in accordance with the second selection signal CS2 of the first logic state.

However, if the condition expressed by the Equation 8 is not satisfied, i.e., if it is determined that the gray level of the first luminance data YPn is smaller than the gray level of the second luminance data YPn+1, the second comparator 145 transmits the second selection signal CS2 of the second logic state to the adder/subtracter 146. The adder/subtracter 146 subtracts the offset from the gray level of the first luminance data YPn in accordance with the second selection signal CS2 of the second logic state. Also, the adder/subtracter 146 adds the offset to the gray level of the second luminance data YPn+1 in accordance with the second selection signal CS2 of the second logic state.

Afterwards, the adder/subtracter 146 transmits the converted first and second luminance data Y'Pn and Y'Pn+1 to the mixing unit 134. The mixing unit 134 generates the modulated data MRGB using the converted first and second luminance data Y'Pn and Y'Pn+1 and the delayed chrominance data DUV in accordance with the equations 5 and 6.

In the aforementioned method for driving an LCD device according to the embodiment of the present invention, the reference value Ref and the offset are respectively input to the data modulator 110 to analyze the difference in gray level between the luminance data Y of the video data RGB by using the reference value Ref, whereby the difference in gray level between adjacent pixels can be increased by using the offset in accordance with the analyzed result.

The method for modulating video data according to the embodiment of the present invention can be applied to various flat displays, including FED, PDP, and LED, in addition to LCD. As described above, in the apparatus and method for driving an LCD device according to the present invention, the difference in gray level of the analyzed video data can be increased by adding and subtracting steps in the range of the input offset. Accordingly, luminance and resolution of images can be improved to correspond to the input video data. In other words, since luminance can be emphasized to correspond to the video data of a portion where text messages in stationary images or moving images, which require fineness, are displayed, it is possible to improve reading ability of the text messages.

It will be apparent to those skilled in the art that various modifications and variations can be made in the apparatus and method for driving liquid crystal display devices of the present invention without departing from the spirit or scope of the invention. Thus, it is intended that the present invention cover the modifications and variations of this invention provided they come within the scope of the appended claims and their equivalents.

What is claimed is:

1. An apparatus for driving an LCD device, comprising:

an LCD panel having a plurality of gate lines and a plurality of data lines;

a data converter analyzing the difference in gray level between adjacent pixels of input video data and outputting modulated video data if the difference of gray level between adjacent pixels is larger than a reference value;

a timing controller aligning and outputting the modulated video data, a gate driver supplying scan pulses to the gate lines of the LCD panel; and a data driver supplying the modulated video data to the data lines of the LCD panel, wherein the data converter includes a luminance/chrominance separator separating luminance data and chrominance data from the input video data, a delay unit delaying the chrominance data separated from the luminance/chrominance separator, a gray level converter outputting modulated luminance data having increased difference in gray level between a first and a second luminance data from the luminance/chrominance separator if the difference in gray level between the first and second luminance data is larger than the reference value, and a mixing unit generating the modulated video data by mixing the delayed chrominance data with the modulated luminance data and outputting the modulated video data to the timing controller.

2. The apparatus as claimed in claim 1, wherein the gray level converter includes:

a luminance delay unit delaying the luminance data Y from the luminance/chrominance separator to output the first luminance data;

a first comparator comparing the difference in gray level between the first luminance data and the second luminance data with the reference value to output a first selection signal of a first logic state or a second logic state in accordance with the comparison result;

first and second selectors selecting output positions of the first and second luminance data in accordance with the first selection signal of the first or second logic state;

a second comparator comparing gray levels of the first and second luminance data output from the first and second selectors with each other to output a second selection signal of a first or second logic state in accordance with the comparison result; and an adder/subtracter adding and subtracting the offset to and from the first and second luminance data in accordance with the second selection signal.

3. The apparatus as claimed in claim 2, wherein the first comparator outputs the selection signal of the first logic state if the difference in gray level between the first and second luminance data is smaller than the reference value, and outputs the selection signal of the second logic state if the difference in gray level between the first and second luminance data is larger than the reference value.

4. The apparatus as claimed in claim 2, wherein the first and second selectors transmit the first luminance data and the second luminance data to the mixing unit, respectively, when the first comparator outputs the first selection signal corresponding to the first logic state.

5. The apparatus as claimed in claim 2, wherein the first and second selectors transmit the first luminance data and the second luminance data to the second comparator when the first comparator outputs the first selection signal according to the second logic state.

6. The apparatus as claimed in claim 2, wherein the second comparator transmits the second selection signal corresponding to the first logic state to the adder/subtracter if the gray level of the first luminance data is larger than the gray level of the second luminance data.

7. The apparatus as claimed in claim 6, wherein the adder/subtracter adds the offset to the gray level of the first luminance data and subtracts the offset from the gray level of the second luminance data, in accordance with the second selection signal of the first logic state.

8. The apparatus as claimed in claim 2, wherein the second comparator transmits the second selection signal corresponding to the second logic state to the adder/subtracter if the gray level of the first luminance data is smaller than the gray level of the second luminance data.

9. The apparatus as claimed in claim 8, wherein the adder/subtracter subtracts the offset from the gray level of the first luminance data and adds the offset to the gray level of the second luminance data, in accordance with the second selection signal of the second logic state.

10. The apparatus as claimed in claim 2, wherein the adder/subtracter subtracts the offset from one of the first and second luminance data having lower gray level and adds the offset to one of the first and second luminance data having higher gray level, in accordance with the second selection signal, so as to increase the difference in gray level between the first and second luminance data.

11. A method for driving an LCD device, comprising:

separating luminance data and chrominance data from externally input video data;

delaying the chrominance data;

generating modulated luminance data having increased difference in gray level between first and second luminance data if the difference in gray level between the first and second luminance data is larger than a reference value; and generating modulated video data by mixing the chrominance data and the modulated luminance data, wherein the step of generating the modulated luminance data includes comparing the difference in gray level between the first and second luminance data with the reference value, comparing gray level the first luminance data with gray level of the second luminance data, modulating luminance data by adding and subtracting offset to and from the first and second luminance data in accordance with the second selection signal if the difference in gray level between the first and second luminance data is larger than the reference value, and outputting the modulated luminance data.

12. The method as claimed in claim 11, wherein the step of modulating luminance data includes adding the offset to one of the first and second luminance data having larger gray levels and subtracting the offset from one of the first and second luminance data having lower gray levels.

13. The method as claimed in claim 11, wherein the step of modulating luminance data includes;

adding the offset to the gray level of the first luminance data and subtracting the offset from the gray level of the second luminance data, if the gray level of the first luminance data is larger than the gray level of the second luminance data.

14. The method as claimed in claim 11, wherein the step of modulating luminance data includes;

adding the offset to the gray level of the second luminance data and subtracting the offset from the gray level of the first luminance data, if the gray level of the first luminance data is smaller than the gray level of the second luminance data.

* * * * *